United States Patent [19]

Lemke

[11] Patent Number: 4,731,031

[45] Date of Patent: Mar. 15, 1988

[54] TRANSMISSION CABLE CONNECTOR HAVING A CONTOURED SHELL

[75] Inventor: Timothy A. Lemke, Carlisle, Pa.

[73] Assignee: E. I. Du Pont de Nemours and Company, Wilmington, Del.

[21] Appl. No.: 919,029

[22] Filed: Oct. 15, 1986

[51] Int. Cl.[4] ..... H01R 9/09

[52] U.S. Cl. ..... 439/76; 439/607

[58] Field of Search ..... 339/14 R, 143 R, 17 LC, 339/17 F, 176 MF, 193 P; 439/76, 607

[56] References Cited

U.S. PATENT DOCUMENTS

| | | | |
|---|---|---|---|
| 3,573,704 | 4/1971 | Tarver | 339/14 R |
| 4,157,612 | 6/1979 | Rainal | 339/176 MF |
| 4,416,501 | 11/1983 | Fusselman et al. | 339/97 R |
| 4,601,527 | 7/1986 | Lemke | 339/14 R |
| 4,603,936 | 8/1986 | Jagen | 339/143 R |
| 4,632,486 | 12/1986 | Hasircoglu | 339/99 R |
| 4,641,902 | 2/1987 | Fusselman | 339/91 R |

FOREIGN PATENT DOCUMENTS

| | | | |
|---|---|---|---|
| 90539 | 10/1983 | European Pat. Off. | 339/143 R |
| 2101203 | 7/1971 | Fed. Rep. of Germany | 339/193 P |

OTHER PUBLICATIONS

DuPont Connector Systems catalog 86-A, pp. 362-377.

*Primary Examiner*—John McQuade

[57] ABSTRACT

A transmission cable connector having a shell with a conductive layer thereon is contoured to place the layer a predetermined distance from the extending individual conductor wires of the cable, the contacts of the connector, the point of interconnection therebetween, and/or from the tracings on the surface of a transition board, if one is provided, all of which are provided in the transition region between the end of the cable and the contacts of the connector. The predetermined distance is determined such that when the conductive layer of the shell is connected to a predetermined potential electrical characteristics are imparted to the elements in the transition region that closely match the electrical characteristics of the cable attachable to the connector.

12 Claims, 3 Drawing Figures

TRANSMISSION CABLE CONNECTOR HAVING A CONTOURED SHELL

BACKGROUND OF THE INVENTION

1. Field of the Invention

This invention relates to a connector for a transmission cable and, in particular, to a connector having a contoured conductive shell thereon adapted to provide an impedance control function in the transition region where the conductors of the cable are joined to the contacts of the connector.

2. Description of the Prior Art

A transmission cable connector is an electrical connector component adapted to interconnect each electrical conductor of a cable to a respective complementary contact. The structure of the cable is meticulously designed and fabricated so that the electrical characteristics of the cable (including impedance and crosstalk) may be precisely controlled.

Such cables, which may be in round or flat form, are typically interconnected to other circuit components using a transmission cable connector. In the case of a round cable the interconnection is usually made by first fanning the extending ends of the cable into a generally planar array and securing each of the wires of the individual conductors to the respective contacts provided in the connector. The interconnection between the extending conductors and the contacts may be directly made, as by solder.

In some instances the center-to-center spacing of adjacent conductors in the planar array of conductors is different than the center-to-center spacing of the contacts in the connector. In such a case a transition circuit board is provided. The transition circuit board is a generally planar substrate having an array of conductive tracings with termination pads formed at each end of each tracing. Such tracings and pads may be disposed on one or both of the surfaces of the substrate. The individual conductors of the cable are suitably secured to the input pads along one edge of the transition board while the contacts of the connector are soldered into contact with output pads provided along other of the edges of the substrate. Typically the entire connector assembly is surrounded by a plastic housing.

In the typical case little if any consideration is given to the electrical characteristics of the transition region between the ends of the cable and the contacts in the connector, whether or not an intermediate transition board is provided. It is often assumed that the electrical length of the transition region is electrically too short to cause problems with data transmission. However, this is not always true. At higher frequencies the signal transmission benefits, particularly the impedance and crosstalk considerations resulting from precise design of the cable, are lost when one neglects the electrical characteristics of the conductors, contacts and board in the transition region.

Accordingly, in view of the foregoing, it is believed advantageous to provide a transmission cable connector which includes an impedance control arrangement in the transition region between the cable and the connector.

SUMMARY OF THE INVENTION

In one embodiment of the invention a transmission cable connector has an array of metallic contacts which engage an edge of a transition circuit board provided to effect the transition between the ends of the conductors of a cable and the contacts. The cable has predetermined impedance and crosstalk characteristics. The connector is characterized by the provision of a shell having a conductive impedance control surface on the inner surface thereof. The shell is contoured so that the conductive impedance control surface is spaced a predetermined clearance distance away from and in spaced relation to the surface of the transition board. In use, with the control surface connected to a predetermined electrical potential, typically ground potential, the tracings of the transition board together with the impedance control surface of the shell cooperate to impart to the tracings predetermined electrical characteristics which substantially match the electrical characteristics of the cable.

In another embodiment of the invention, adapted for use in the situation where the extending conductors of the cable are directly connected to the contacts of the connector, the conductive impedance control surface is spaced from the extending portion of the conductors, from the contacts, and from the point of interconnection therebetween such that, in use, electrical characteristics are imparted to the transition region having these elements therein which closely match the electrical characteristics of the cable.

BRIEF DESCRIPTION OF THE DRAWINGS

The invention may be more fully understood from the following detailed description thereof taken in connection with the accompanying drawing which forms a part of this application and in which.

DETAILED DESCRIPTION OF THE INVENTION

Figure 1:
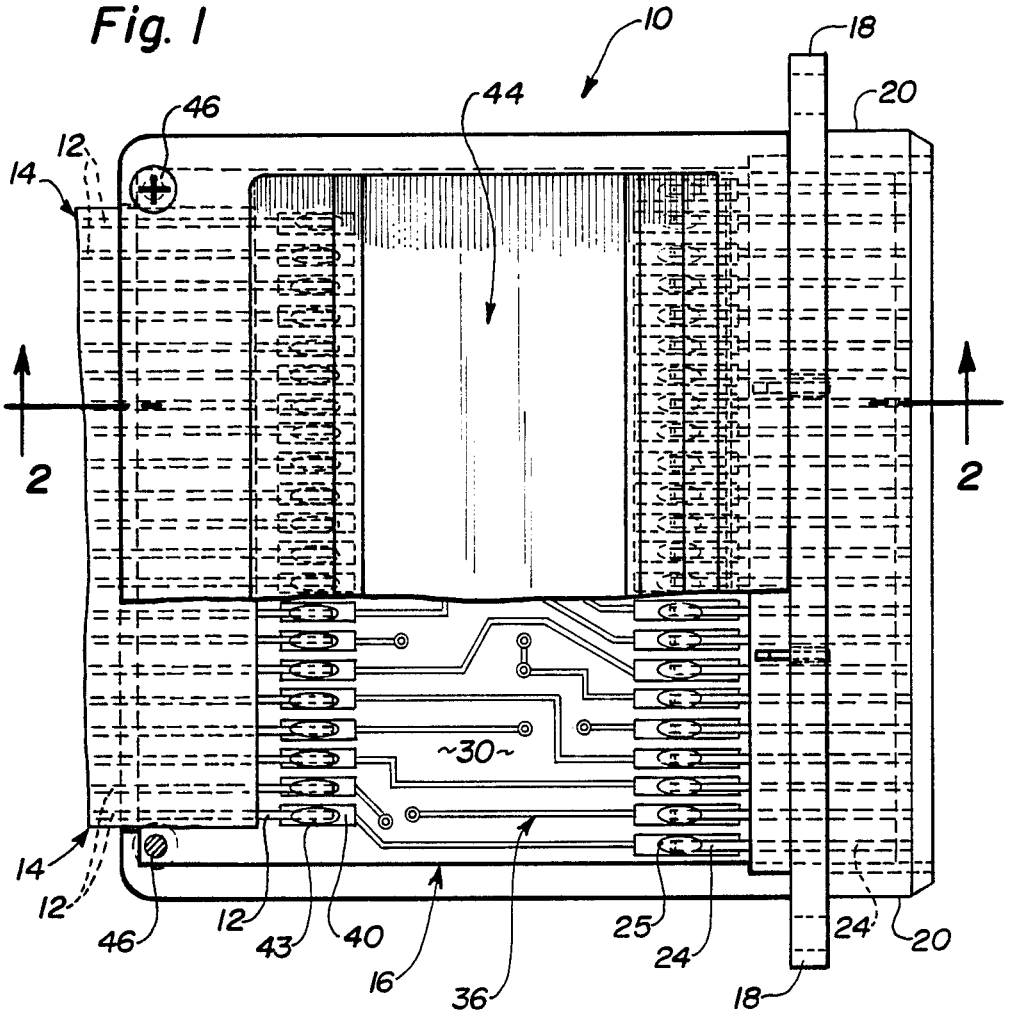
FIG. 1 is a plan view of a connector in accordance with the present invention adapted for use with a transition circuit board, with portions of the shell broken away for clarity.

Throughout the following detailed description similar reference numerals refer to similar elements in all figures of the drawings.

Figure 2:
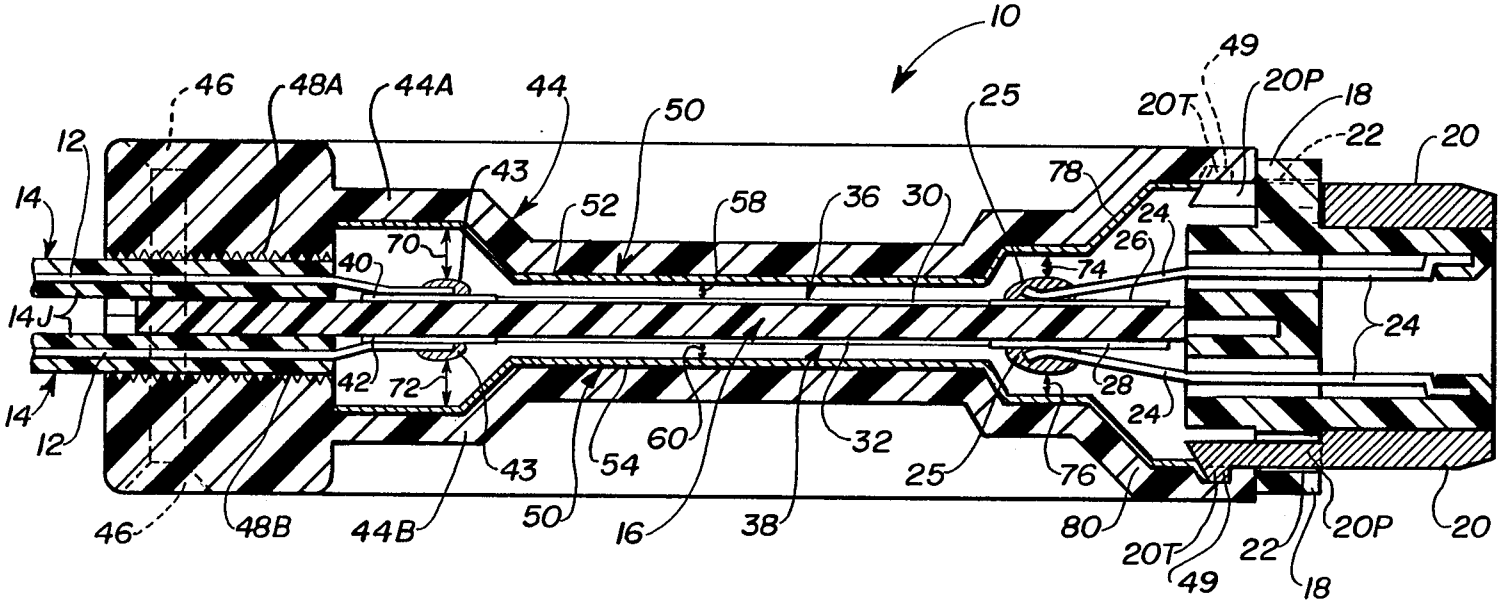
FIG. 2 is a side elevational view entirely in section of the transmission cable connector of FIG. 1 taken along section lines 2—2 thereof.

With reference to the FIGS. 1 and 2 a transmission cable connector generally indicated by reference character 10 embodying the teachings of this invention is shown. The connector 10 is adapted to interconnect the individual conductor wires 12 of a cable 14 to associated user circuitry (not shown) which is attached to the connector 10. In the embodiment of the invention shown in FIGS. 1 and 2 a transition board 16 is used to effect the transition.

The connector 10 includes a header portion 18 formed of a suitable dielectric material, such as molded plastic. A metal shroud 20 is disposed on the header 18. Prongs 20P (FIG. 2) project from the shroud 20 through apertures 22 provided in the header 18. Tabs 20T project from the prongs 20P, for a purpose to be described.

The header 18 carries a predetermined plurality of electrical contacts 24 thereon. It should be understood that any suitable form of contacts 24 may be used in the connector 10 and remain within the contemplation of this invention. The contacts 24 are engaged in soldered contact, as shown by the solder beads 25, with individual contact pads 26, 28 respectively disposed on the upper and lower surfaces 30, 32 of the transition circuit board 16. As noted the board 16 is arranged to form a transition in the region between the ends of the individual wires 12 of the cable 14 and the contacts 24.

The surface 30, 32 of the circuit board 16 carry a predetermined pattern of tracings 36, 38 respectively which extend from the contact pads 40, 42 along one edge of the board 16. The pads 40, 42 respectively correspond to the pads 26, 28 provided along the opposite edge of the board 16.

Figure 3:
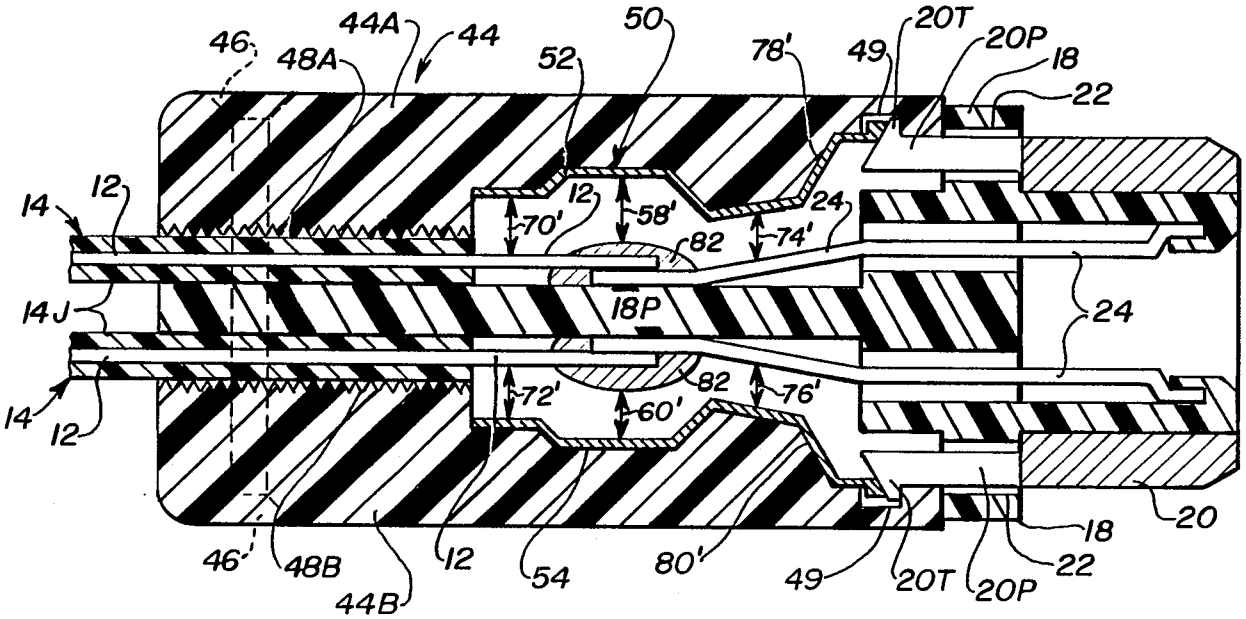
FIG. 3 is a view similar to FIG. 2 of a connector in accordance with the present invention adapted for use when the conductors of the cable are directly connected to the contacts of the connector.

The cable 14 may be either a planar (flat) cable or a round cable having a spirally wound array of conductors therein. Each form of cable 14 includes an insulation jacket 14J (FIGS. 2, 3). To effect the interconnection of the individual conductors 12 of the cable 14 the jacket 14J is removed and, in the case of a round cable, the conductor wires 12 in the cable fanned out in a generally planar configuration. The extending, individual conductor wires 12 are stripped of their jackets 14J. The wires 12 are soldered or otherwise suitably attached to the pads 40, 42, as the case may be, as shown by the solder beads 43.

The wires 12 of the cable 14 are held in place in the vicinity of the pads 40, 42 by a shell 44. The shell 44 is comprised of upper and lower members 44A, 44B, typically formed of a plastic material. The members 44A, 44B are secured together by screws 46. Serrations 48A, 48B (FIGS. 2, 3), respectively provided on the shell members 44A, 44B, grasp the insulation jacked 14J of the cable to assist in securing the cable in place. The shell members 44A, 44B are held in the vicinity of the header 18 by the interengagement of the tabs 20T of the shroud 20 with notches 49 provided in the shell members 44. It should be understood that any suitable expedient may be used to secure the cable to the shell 44 and the shell 44 to the header 18. It should also be understood that suitable bus bars (not shown) may also be provided on the surface of the board to provide suitable terminations for any ground signals disposed within the cable 14.

The cable 14 is constructed so as to exhibit predetermined electrical characteristics. In particular the impedance of the cable 14 as well as the effects on a given conductor due to the presence of one or more adjacent conductors is minimized. In accordance with the present invention the connector 10 is provided with an impedance control arrangement 50 whereby the electrical characteristics of the elements in the transition region between the end of the cable 14 and the contacts 24 of the connector 10 are generally matched to those of the cable 14. The impedance control arrangement is implemented by conductive layers 52, 54 on the inner surfaces of the upper and lower shell members 44A, 44B, respectively. Of course, if the shell members 44A, 44B are themselves formed of a conductive material, no additional inner conductive layers need be provided.

The shell members 44A, 44B are contoured to dispose the inner conductive layers 52, 54 on the inner surfaces of the shell members into predetermined close distances 58, 60 from the respective proximal surfaces 30, 32 of the transition board 16. Preferably, the layers 52, 54 are generally parallel to the surfaces 30, 32, respectively of the board 16. The spacings 58, 60 are selected such that the tracing patterns 36, 38 on the respective surfaces 30, 32 of the transition board 16, in conjunction with the metallic layers 52, 54 of the shell 44, and are arranged so that, in use, with the conductive layers 52, 54 connected to a predetermined potential (typically ground potential), the layers 52, 54 act as impedance control surfaces or ground planes. Thus, the layers 52, 54 of the shell members 44A, 44B lying the respective predetermined distances 58, 60 from the surfaces 30, 32 of the board 16, taken in conjunction with the spacing, density, and pattern of the respective tracings 36, 38 on those surfaces of the board, impart to the tracings 36, 38 electrical characteristics that substantially match the electrical characteristics of the cable 14.

In addition, the conductive layers 52, 54 are respectively spaced predetermined distances 70, 72 from the area of interconnection 43, between the extending wires 12 of the cable 14 and the pads 40, 42 on their respective surfaces of the board 16. Further, the layers 52, 54 are respectively spaced predetermined distances 74, 76 between tracings 36, 38 and the interconnections between thee tracings, pads 26, 28 and the contacts 24. These spacings 70–76 are arranged to impart electrical characteristics to these areas of interconnection which match the electrical characteristics of the cable. It also lies within the contemplation of this invention to appropriately contour the layers 52, 54 in the respective regions 78, 80 where the contacts 24 extend from the pads 26, 28 toward the header 18.

The interconnection between the layers 52, 54 and the appropriate ground potential is effected by contact between the layers 52, 54 and the tabs 20T which are attached to the prongs 20P projecting from the shroud 20. Of course, any other suitable means of connection with the layers 52, 54 may be used and remain within the contemplation of the present invention.

As seen in FIG. 3 the teachings of this invention are applicable to arrangements wherein the extending wires 12 of the cables are directly joined to the contacts 24. Typically, the jointure is soldered, as shown by the bead 82. In this embodiment the ends of the cable are clamped between a central plank 18P extending from the header 18 and the shell members 44A, 44B. In this FIG. 3, the reference characters 58', 60'; 70', 72'; and 74', 76' respectively represent the clearance distances between the area of interconnection between the wires 12 and the contacts 24; the extending portion of the wires 12; and the contacts 24. The layers 52, 54 may also be appropriately contoured in the regions 78', 80'. Note that in FIG. 2 the exterior of the shells 44A, 44B are recessed, while in the embodiment of FIG. 3, the exterior of the shells are planar.

From the foregoing it may be appreciated that, when connected to the appropriate electrical potential, the ground planes provided by the conductive layers 52, 54 of the shell 44 maintain the signal integrity of the signals carried on the individual wires 12 through the transition region between the end of the cable 14 and the contacts 24. By appropriately contouring the metallic conductive layers of the shell and spacing them the predetermined distances from the extending conductor wires, the tracings on the board surface, the contact pads and/or the contacts, the electrical characteristics of these elements in the transition region may be made to closely match the electrical characteristics of the cable.

Those skilled in the art, having the benefit of the teachings of the present invention as hereinabove set forth, may affect numerous modifications thereto. For example, although the invention has been described in connection with a double-sided (i.e., tracings on both surfaces) transition circuit board, the invention has equal utility with single-sided boards. Moreover, although a female connector is illustrated, the invention may also be used with a male connector configuration. Furthermore, the layers need not be contoured over the entire transition region to obtain the benefits of the present invention. Thus, in FIGS. 1 and 2, beneficial advantages would obtain were the parallel spacings 58, 60 in the region overlying only the surface of the board maintained. However, the more precise the contours and the spacings between the conductive layers 52, 54 and the various elements in the transition region, the more closely matched are the electrical characteristics of the elements in this region to those of the cable. These modifications are, however, to be construed as lying within the scope of the present invention as defined by the appended claims.

What is claimed is:

1. In a connector of the type having a plurality of contacts, a planar substrate having an array of tracings on at least one surface thereof, the contacts being adapted to engage electrically the tracings on the substrate so that the individual tracings are connected to a respective one of the contacts as well as to a respective one of a plurality of individual conductor wires of a cable, the cable having predetermined electrical characteristics associated therewith, the connector having a shell thereon, the improvement comprising:

a conductive inner layer disposed on the shell, the shell being contoured to space the conductive inner layer at a first predetermined clearance distance from the surface of the substrate such that, in use, with the inner surface of the shell connected to a predetermined electrical potential the tracings on the surface of the substrate and the conductive inner surface of the shell cooperate to impart to the tracings predetermined electrical characteristics that closely match the electrical characteristics of the cable.

2. The connector of claim 1 wherein the conductive inner layer is disposed in parallel to the surface of the substrate.

3. The connector of claim 2 wherein the improvement further comprises the shell being contoured to space the conductive inner layer a second predetermined clearance distance from the interconnection between the tracings and the wires of the cable.

4. The connector of claim 1 wherein the improvement further comprises the shell being contoured to space the conductive inner layer a second predetermined clearance distance from the interconnection between the tracings and the wires of the cable.

5. The connector of claim 2 wherein the improvement further comprises the shell being contoured to space the conductive inner layer a second predetermined clearance from the interconnection between the tracings and the contacts.

6. The connector of claim 1 wherein the improvement further comprises the shell being contoured to space the conductive inner layer a second predetermined clearance from the interconnection between the tracings and the contacts.

7. The connector of claim 6 wherein the improvement further comprises the shell being contoured to space the conductive inner layer a third predetermined distance from the interconnection between the tracing and the wires of the cable.

8. The connector of claim 5 wherein the improvement further comprises the shell being contoured to space the conductive inner layer a third predetermined distance from the interconnection between the tracing and the wires of the cable.

9. In a connector of the type having a plurality of contacts each of which is connected to an extending portion of an individual conductor wire of a cable, the cable having predetermined electrical characteristics associated therewith, the connector having a shell thereon, the improvement comprising:

a conductive inner layer disposed on the shell, the shell being contoured to space the conductive layer at a predetermined clearance distance from the point of interconnection between the contacts and the extending portion of the conductors such that, in use, with the inner layer of the shell connected to a predetermined electrical potential, electrical characteristics which closely match those of the cable are imparted to the conductor wires, the contacts and the point of interconnection therebetween.

10. The connector of claim 9 wherein the improvement further comprises the shell being contoured to space the conductive inner layer a second predetermined clearance distance from the extending portions of the wires of the cable.

11. The connector of claim 9 wherein the improvement further comprises the shell being contoured to space the conductive inner layer a second predetermined clearance distance from the contacts.

12. The connector of claim 11 wherein the improvement further comprises the shell being contoured to space the conductive inner layer a third predetermined clearance distance from the extending portions of the wires of the cable.

* * * * *